US012320352B2

(12) United States Patent
Lee et al.

(10) Patent No.: US 12,320,352 B2
(45) Date of Patent: Jun. 3, 2025

(54) COMPRESSOR

(71) Applicant: Fu Sheng Industrial Co. Ltd., Taipei (TW)

(72) Inventors: Hsun-An Lee, Taipei (TW); Xuan-Fu Li, New Taipei (TW)

(73) Assignee: Fu Sheng Industrial Co. Ltd., Taipei (TW)

( * ) Notice: Subject to any disclaimer, the term of this patent is extended or adjusted under 35 U.S.C. 154(b) by 0 days.

(21) Appl. No.: 18/780,527

(22) Filed: Jul. 23, 2024

(65) Prior Publication Data

US 2025/0052239 A1 Feb. 13, 2025

(30) Foreign Application Priority Data

Aug. 11, 2023 (TW) ..... 112130260

(51) Int. Cl.
*F04C 18/02* (2006.01)
*F04C 29/00* (2006.01)

(52) U.S. Cl.
CPC ..... *F04C 18/0215* (2013.01); *F04C 29/0057* (2013.01); *F04C 2240/30* (2013.01);
(Continued)

(58) Field of Classification Search
CPC ..... F04C 18/02–0292; F04C 29/0057; F04C 29/0042; F04C 29/005; F04C 29/0071;
(Continued)

(56) References Cited

U.S. PATENT DOCUMENTS 4,836,758 A * 6/1989 Elson ..... F01C 21/02 384/271
5,328,342 A * 7/1994 Ishii ..... F04C 29/0057 418/57

(Continued)

FOREIGN PATENT DOCUMENTS

CN 201396285 2/2010
EP 2713053 A1 * 4/2014 ..... F01C 21/02

(Continued)

OTHER PUBLICATIONS

"Search Report of Europe Counterpart Application", issued on Jan. 14, 2025, p. 1-p. 7.

*Primary Examiner* — Mark A Laurenzi
*Assistant Examiner* — Xiaoting Hu
(74) *Attorney, Agent, or Firm* — JCIPRNET

(57) ABSTRACT

A compressor includes a housing, a motor disposed in the housing, a driving shaft connected to the motor, a first compression mechanism connected to the driving shaft, and a second compression mechanism. The second compression mechanism includes a stationary scroll and an orbiting scroll engaged with each other, a bushing seat positioned at an end portion of the driving shaft, a bushing, and a bearing. A main axis of the driving shaft passes through a positioning protrusion of the bushing seat, and the positioning protrusion is deflected at an angle relative to a straight line connected by a plurality of contact points between the orbiting scroll and the stationary scroll. The bushing is sleeved on the positioning protrusion, and a center line of the bushing is eccentric to the main axis. The bearing is sleeved on the bushing, and the orbiting scroll is sleeved on the bearing.

24 Claims, 14 Drawing Sheets

(52) U.S. Cl.
CPC ..... *F04C 2240/40* (2013.01); *F04C 2240/56* (2013.01); *F04C 2240/601* (2013.01)

(58) Field of Classification Search
CPC .... F04C 29/0078; F04C 23/00; F04C 23/005; F04C 23/006; F04C 2240/56; F04C 27/001
See application file for complete search history.

(56) References Cited

U.S. PATENT DOCUMENTS

| | | | | |
|---|---|---|---|---|
| 5,582,513 | A * | 12/1996 | Shigeoka | F04C 29/0057 418/57 |
| 5,588,819 | A | 12/1996 | Wallis | |
| 11,028,848 | B2 | 6/2021 | Okamoto et al. | |
| 11,193,488 | B2 | 12/2021 | Fukuhara et al. | |
| 2006/0233654 | A1 | 10/2006 | Gopinathan et al. | |
| 2007/0231175 | A1* | 10/2007 | Suefuji | F04C 18/0215 418/55.3 |
| 2015/0093276 | A1* | 4/2015 | Kanemoto | F01C 21/02 418/55.5 |
| 2017/0082109 | A1* | 3/2017 | Kawamura | F04C 29/0078 |
| 2017/0268340 | A1* | 9/2017 | Ootani | F01C 21/008 |
| 2019/0032664 | A1* | 1/2019 | Crum | F04C 29/023 |
| 2020/0041170 | A1* | 2/2020 | Lee | F04C 29/02 |
| 2022/0260076 | A1* | 8/2022 | Hu | F04C 18/0215 |

FOREIGN PATENT DOCUMENTS

| | | | | |
|---|---|---|---|---|
| KR | 20010087674 | A * | 9/2001 | |
| TW | 316941 | | 10/1997 | |
| TW | 201736787 | | 10/2017 | |
| WO | WO-2005068841 | A1 * | 7/2005 | F04C 18/0215 |
| WO | 2015107705 | | 7/2015 | |
| WO | 2018078787 | | 5/2018 | |
| WO | 2021203638 | | 10/2021 | |

* cited by examiner

COMPRESSOR

CROSS-REFERENCE TO RELATED APPLICATION

This application claims the priority benefit of Taiwan application serial no. 112130260, filed on Aug. 11, 2023. The entirety of the above-mentioned patent application is hereby incorporated by reference herein and made a part of this specification.

BACKGROUND

Technical Field

The disclosure relates to a compressor.

Description of Related Art

After the low-pressure gaseous fluid from the evaporator is sent to a two-stage compressor, it is compressed in the first compression chamber and the second compression chamber respectively by the first compression mechanism and the second compression mechanism to form into high-pressure gaseous fluid, so that the efficiency of the refrigeration cycle may be improved. For example, the first compression mechanism may be a screw compression mechanism, and the second compression mechanism may be a scroll compression mechanism.

Specifically, the scroll compression mechanism includes an orbiting scroll and a stationary scroll, and the motor drives the orbiting scroll to orbit relative to the stationary scroll through a driving shaft. As the orbiting scroll orbits, the orbiting scroll and the stationary scroll generate a plurality of contact points in the radial direction to form a plurality of compression spaces whose volumes gradually decrease from the outer periphery to the center, so that the gaseous fluid is continuously pressurized to transform into high-pressure gaseous fluid, which is discharged from the second compression chamber through the center of the stationary scroll.

Generally speaking, the end portion of the driving shaft is an eccentric shaft portion. The bushing is sleeved on the eccentric shaft portion, and the orbiting scroll is sleeved on the bushing through the bearing. Therefore, the inertial force generated by the orbiting scroll while orbiting will be transmitted to the eccentric shaft portion, which not only increases the load on the bearing, but also causes uneven stress on the bearing, thereby causing severe abrasion in specific areas of the bearing to affect the operating efficiency and the lifetime of the compressor.

On the other hand, the bushing is slidably sleeved on the eccentric shaft portion in the radial direction, and the orbiting scroll can slide synchronously with the bushing in the radial direction. Since the plurality of contact points between the orbiting scroll and the stationary scroll are connected in a straight line in the radial direction and coincide with the radial sliding path and retreat path of the bushing, when abnormally high pressure is generated in the plurality of compression spaces, the orbiting scroll and the bushing cannot easily slide in the radial direction. That is, the orbiting scroll and the bushing cannot easily retreat in the radial direction, resulting in the orbiting scroll being unable to smoothly orbit relative to the stationary scroll.

SUMMARY

The disclosure provides a compressor, which helps to improve the operating efficiency and the lifetime.

The disclosure proposes a compressor, which includes a housing, a motor, a driving shaft, a first compression mechanism, and a second compression mechanism. The housing has a first compression chamber and a second compression chamber that are communicated with each other. The motor is disposed in the housing. The driving shaft is connected to the motor. The driving shaft passes through the first compression chamber and extends into the second compression chamber. The first compression mechanism is disposed in the first compression chamber and connected to the driving shaft. The second compression mechanism is disposed in the second compression chamber and includes a stationary scroll, an orbiting scroll, a bushing seat, a bushing, and a bearing. The orbiting scroll is engaged with the stationary scroll, and there are a plurality of contact points between the orbiting scroll and the stationary scroll to form a plurality of compression spaces. The bushing seat is positioned at an end portion of the driving shaft and has a positioning protrusion. A main axis of the driving shaft passes through the positioning protrusion, and the positioning protrusion is deflected at an angle relative to a straight line connected by the plurality of contact points. The bushing is sleeved on the positioning protrusion, and a center line of the bushing is eccentric to the main axis. The bearing is sleeved on the bushing, and the orbiting scroll is sleeved on the bearing.

The disclosure proposes another compressor, which includes a housing, a motor, a driving shaft, and a compression mechanism. The housing has a compression chamber. The motor is disposed in the housing. The driving shaft is connected to the motor. The driving shaft extends into the compression chamber. The compression mechanism is disposed in the compression chamber and includes a stationary scroll, an orbiting scroll, a bushing seat, a bushing, and a bearing. The orbiting scroll is engaged with the stationary scroll, and there are a plurality of contact points between the orbiting scroll and the stationary scroll to form a plurality of compression spaces. The bushing seat is positioned at an end portion of the driving shaft and has a positioning protrusion. A main axis of the driving shaft passes through the positioning protrusion, and the positioning protrusion is deflected at an angle relative to a straight line connected by the plurality of contact points. The bushing is sleeved on the positioning protrusion, and a center line of the bushing is eccentric to the main axis. The bearing is sleeved on the bushing, and the orbiting scroll is sleeved on the bearing.

Based on the above, in the compressor of the disclosure, the bushing seat is positioned at the end portion of the driving shaft. The orbiting scroll is connected to the positioning protrusion of the bushing seat through the bearing and the bushing, and the center line of the bushing is eccentric to the main axis of the driving shaft. Specifically, the plurality of contact points between the orbiting scroll and the stationary scroll form the plurality of closed spaces, and the positioning protrusion is deflected at an angle relative to the straight line connected by the plurality of contact points, so that the bearing can receive the force evenly when the orbiting scroll orbits, thereby preventing severe abrasion in specific areas of the bearing due to excessive force to improve the operating efficiency and the lifetime of the compressor.

In order to make the above-mentioned features and advantages of the disclosure clearer and easier to understand, the following embodiments are given and described in details with accompanying drawings as follows.

DESCRIPTION OF THE EMBODIMENTS

Figure 1A:
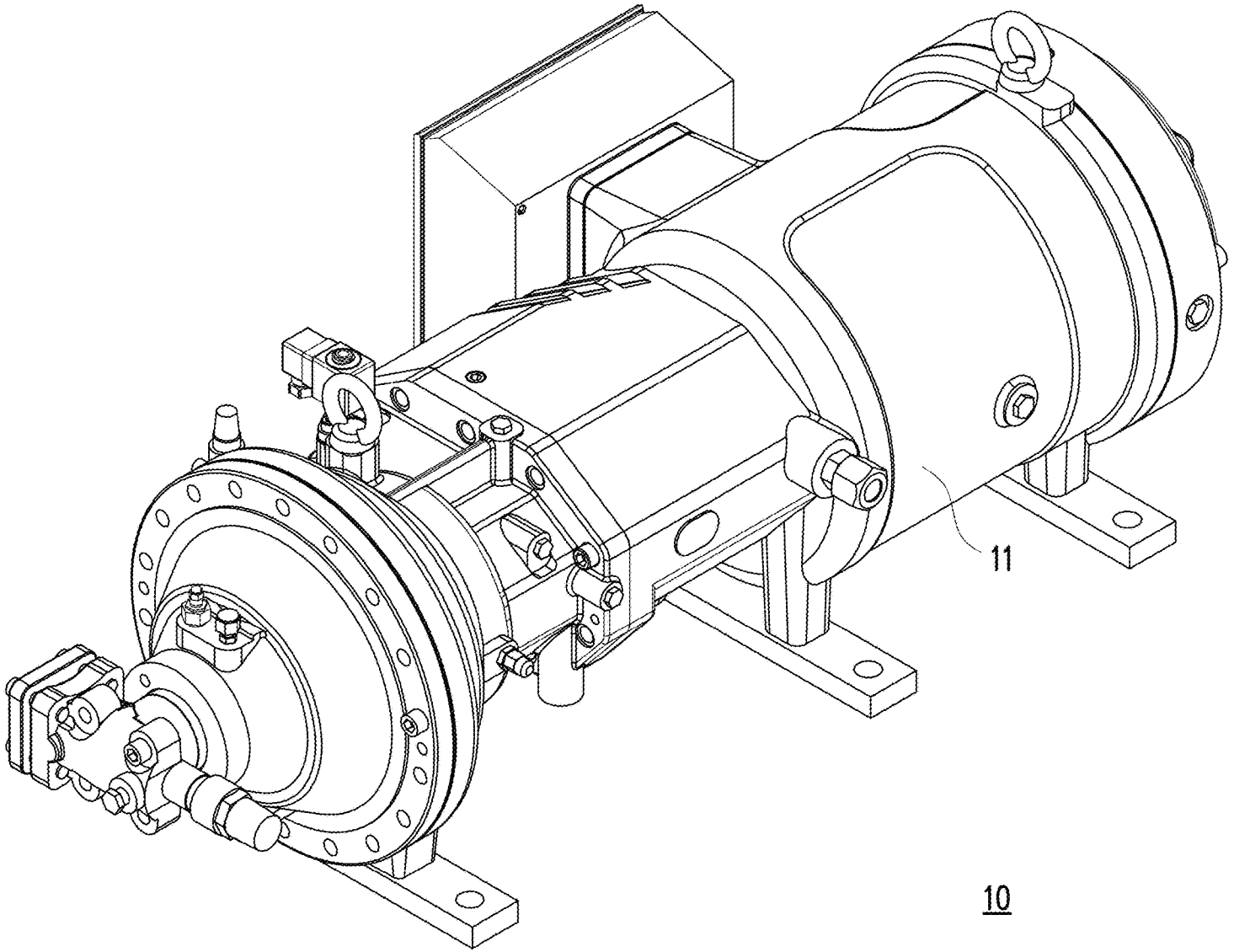
FIG. 1A is a schematic view of a compressor according to an embodiment of the disclosure.
Figure 1B:
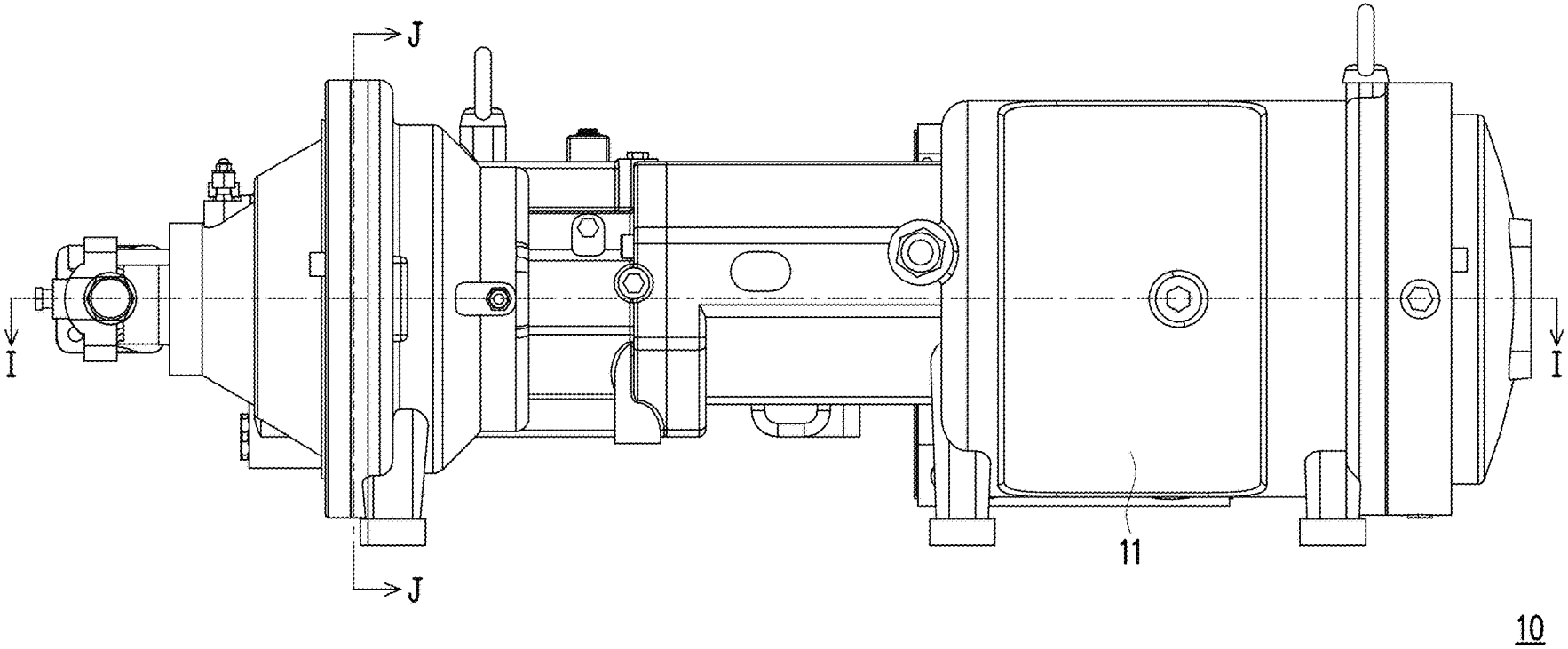
FIG. 1B is a schematic side view of the compressor of FIG. 1A.
Figure 1C:
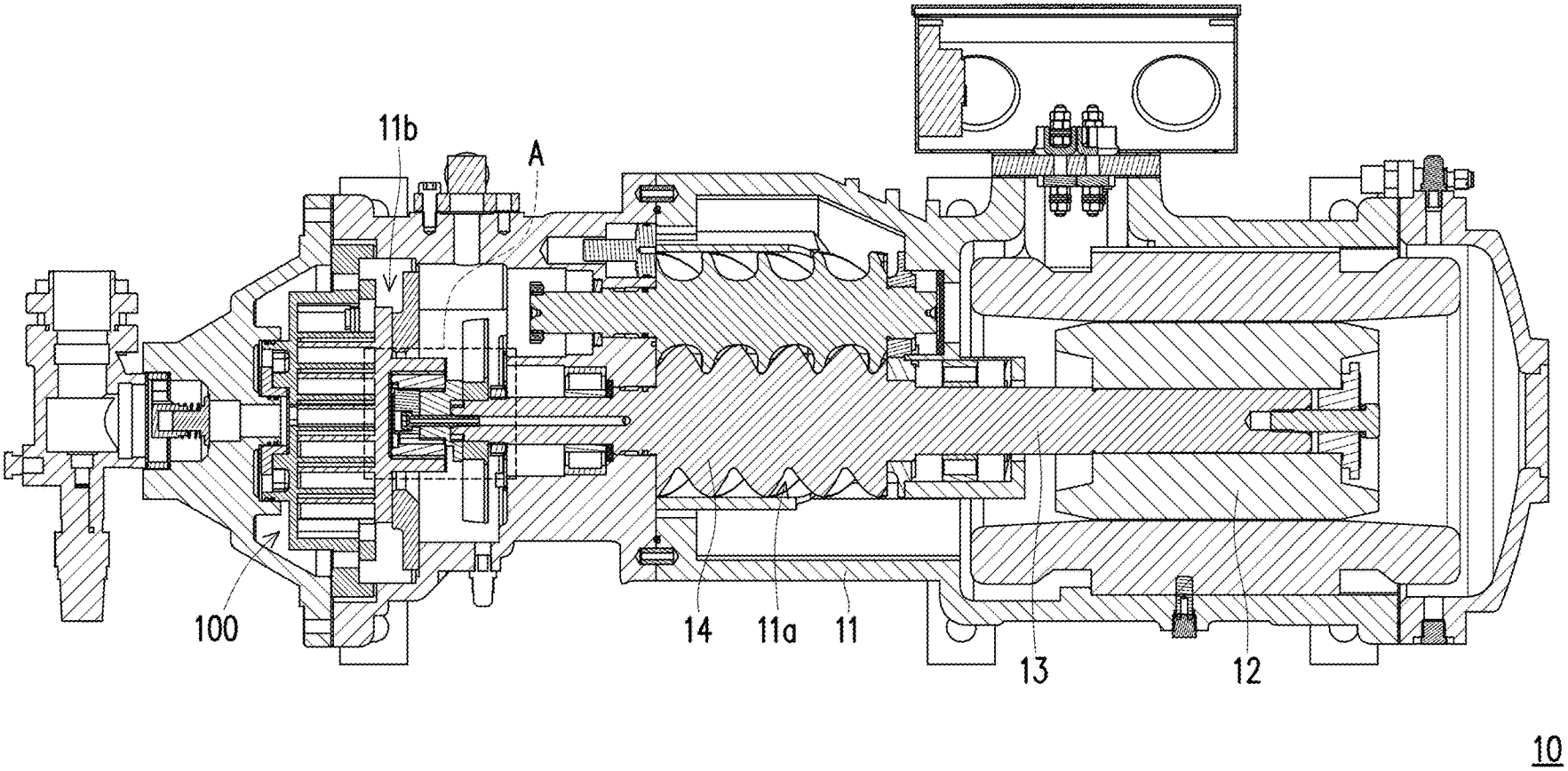
FIG. 1C is a schematic cross-sectional view of the compressor of FIG. 1B along a line segment I-I.
Figure 1D:
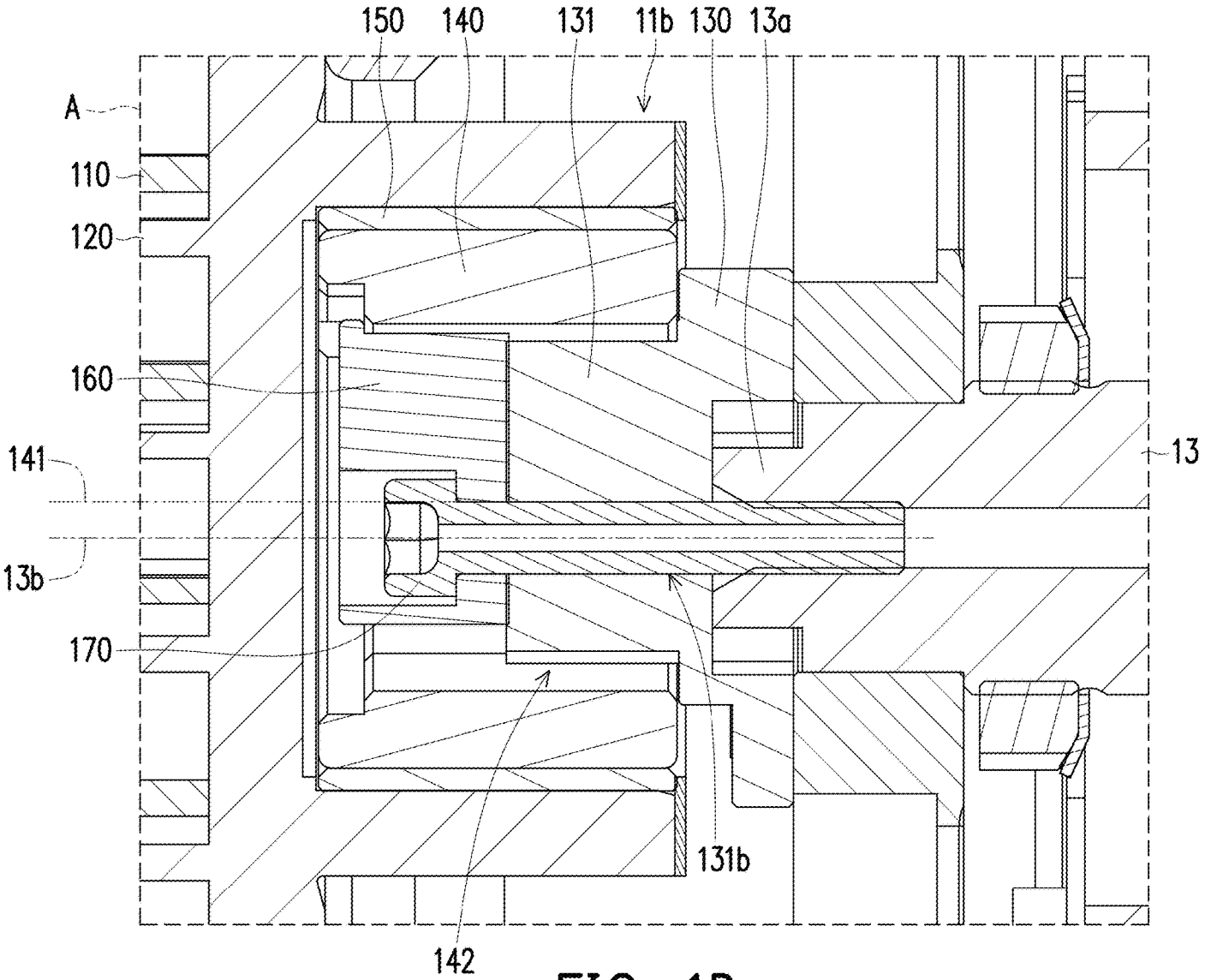
FIG. 1D is a partially enlarged schematic view of part A in FIG. 1C.

FIG. 1A is a schematic view of a compressor according to an embodiment of the disclosure. FIG. 1B is a schematic side view of the compressor of FIG. 1A. FIG. 1C is a schematic cross-sectional view of the compressor of FIG. 1B along a line segment I-I. FIG. 1D is a partially enlarged schematic view of part A in FIG. 1C. Referring to FIG. 1A to FIG. 1C, in the embodiment, a compressor 10 may be a two-stage compressor and includes a housing 11, a motor 12, a driving shaft 13, a first compression mechanism 14, and a second compression mechanism 100. In detail, the housing 11 has a first compression chamber 11*a* and a second compression chamber 11*b* that are communicated with each other. The motor 12 is disposed in the housing 11, and the driving shaft 13 is connected to the motor 12. The first compression mechanism 14 and the second compression mechanism 100 are respectively disposed in the first compression chamber 11*a* and the second compression chamber 11*b*. The driving shaft 13 passes through the first compression chamber 11*a* and extends into the second compression chamber 11*b*.

Referring to FIG. 1C and FIG. 1D, the first compression mechanism 14 can be a screw compression mechanism, and the second compression mechanism 100 can be a scroll compression mechanism. The first compression mechanism 14 is connected to the driving shaft 13, and the second compression mechanism 100 is connected to an end portion 13*a* of the driving shaft 13 located in the second compression chamber 11*b*. The motor 12 can drive the first compression mechanism 14 and the second compression mechanism 100 to operate synchronously through the driving shaft 13, so that the low-pressure gaseous fluid is successively compressed by the first compression mechanism 14 and the second compression mechanism 100 in the first compression chamber 11*a* and the second compression chamber 11*b* to form a high-pressure gaseous fluid, which is then discharged from the second compression chamber 11*b*.

Figure 1E:
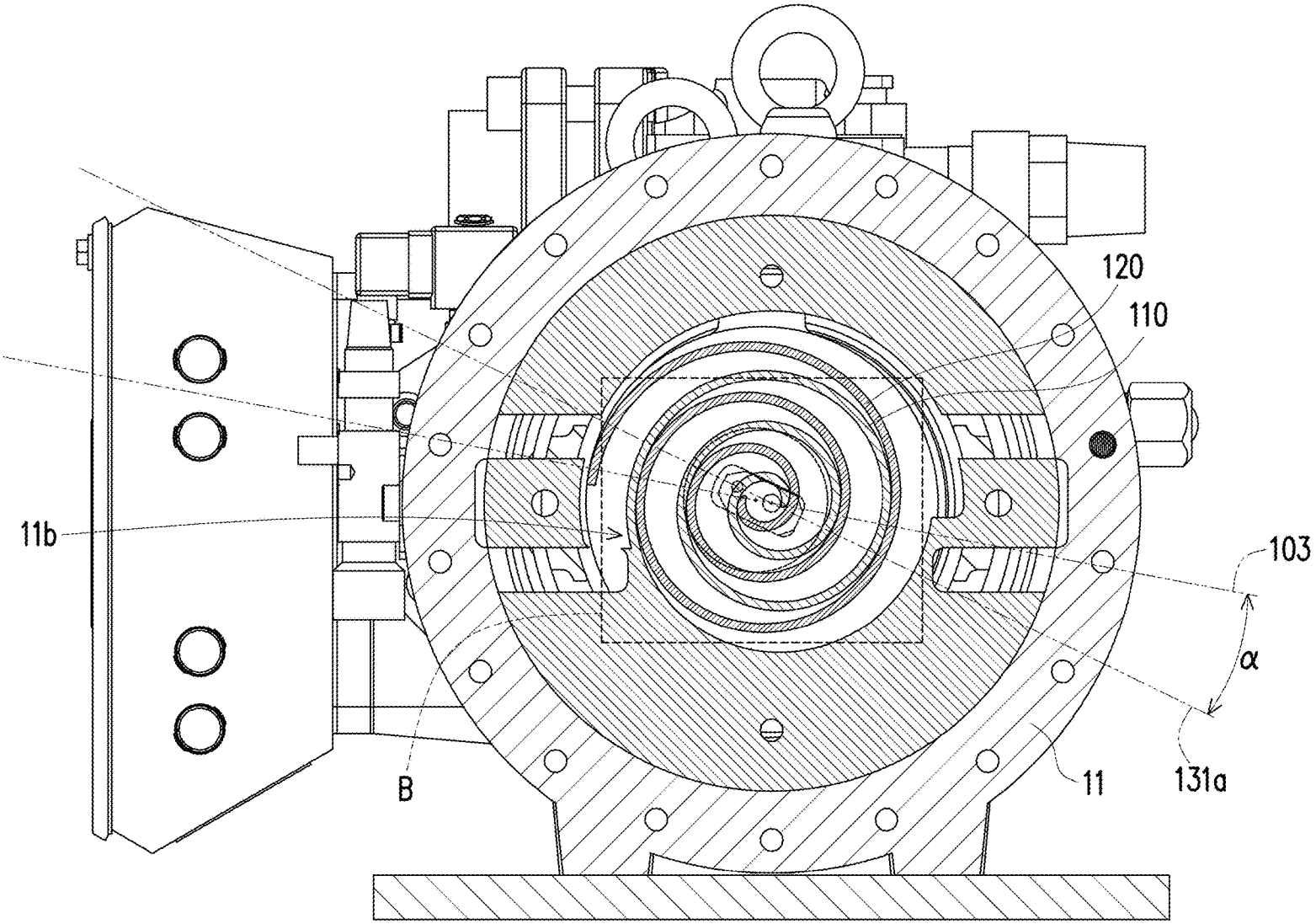
FIG. 1E is a schematic cross-sectional view of the compressor of FIG. 1B along a line segment J-J.
Figure 1F:
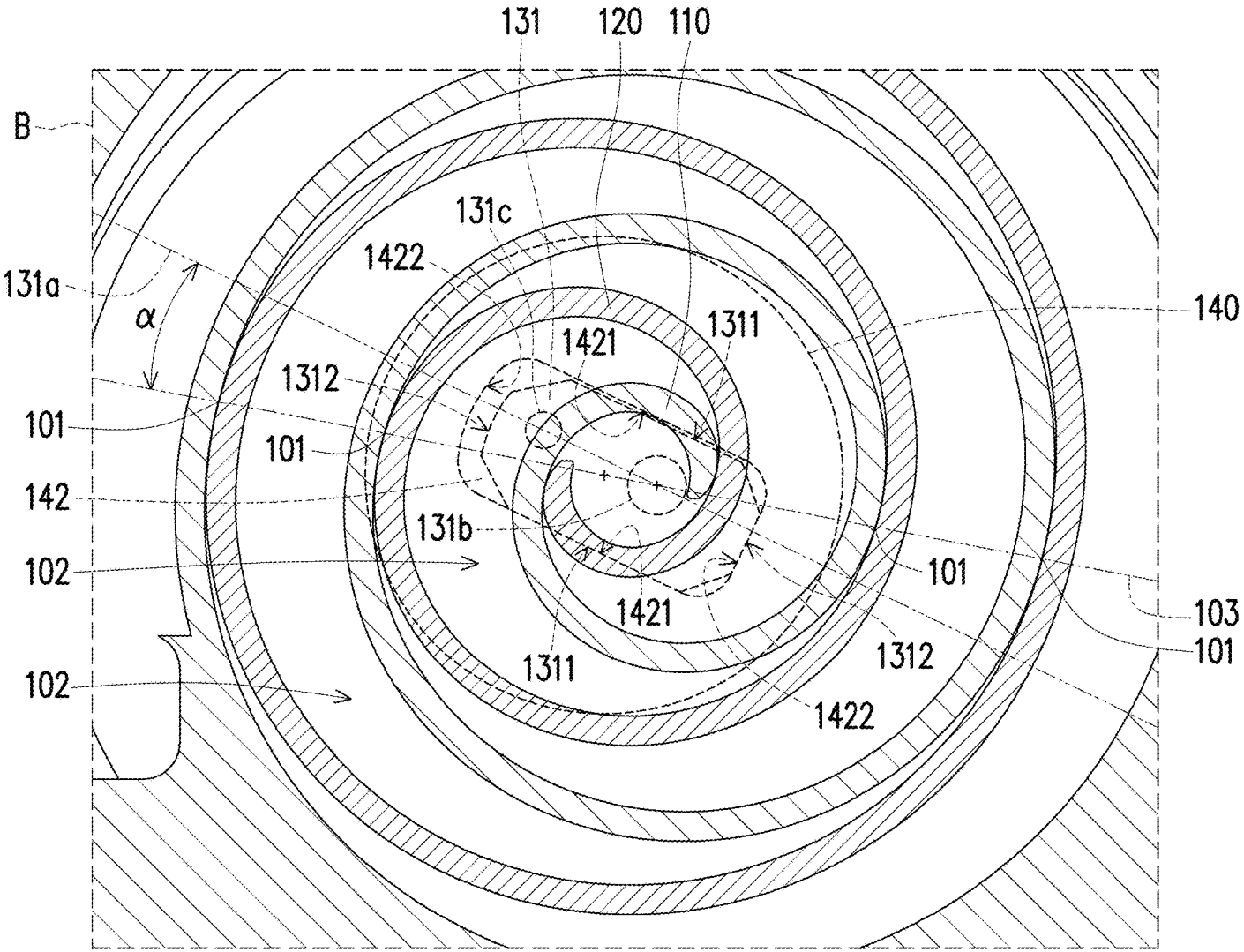
FIG. 1F is a partially enlarged schematic view of part B in FIG. 1E.

FIG. 1E is a schematic cross-sectional view of the compressor of FIG. 1B along a line segment J-J. FIG. 1F is a partially enlarged schematic view of part B in FIG. 1E. Referring to FIG. 1C to FIG. 1F, in the embodiment, the second compression mechanism 100 includes a stationary scroll 110, an orbiting scroll 120, a bushing seat 130, a bushing 140, and a bearing 150. The stationary scroll 110 is fixed in the second compression chamber 11*b*, and the orbiting scroll 120 is engaged with the stationary scroll 110. The orbiting scroll 120 can be driven by the driving shaft 13 to orbit relative to the stationary scroll 110. During the orbiting process of the orbiting scroll 120 relative to the stationary scroll 110, a plurality of contact points 101 are generated between the orbiting scroll 120 and the stationary scroll 110, and a plurality of compression spaces 102 are formed whose volumes gradually decrease from the outer periphery to the center, so that the gaseous fluid is continuously pressurized to transform into high-pressure gaseous fluid, which is then discharged out of the second compression chamber 11*b* from a center of the stationary scroll 110.

Referring to FIG. 1D to FIG. 1F, the bushing seat 130 is positioned at the end portion 13*a* of the driving shaft 13 and has a positioning protrusion 131 protruding toward the stationary scroll 110. A main axis 13*b* of the driving shaft 13 passes through the positioning protrusion 131, and the positioning protrusion 131 is deflected at an angle $\alpha$ relative to a straight line 103 connected by the plurality of contact points 101. On the other hand, the orbiting scroll 120 is connected to the positioning protrusion 131 of the bushing seat 130 through the bearing 150 and the bushing 140. The orbiting scroll 120 is sleeved on the bearing 150, and the bearing 150 is sleeved on the bushing 140. The bushing 140 is sleeved on the positioning protrusion 131, and a center line 141 of the bushing 140 is eccentric to the main axis 13*b*.

Therefore, when the driving shaft 13 drives the bushing seat 130 to rotate, the orbiting scroll 120, the bearing 150, and the bushing 140 can orbit eccentrically around the main axis 13*b*. Under the design of the deflection angle $\alpha$ of the positioning protrusion 131 relative to the straight line 103, the bearing 150 can receive the force evenly when the orbiting scroll 120 orbits, thereby preventing severe abrasion in the specific area of the bearing 150 due to excessive force to improve the operating efficiency and the lifetime of the compressor 10.

For example, the deflection angle $\alpha$ of the positioning protrusion 131 relative to the straight line 103 connected by the plurality of contact points 101 may be an acute angle. Preferably, the angle $\alpha$ may be between 5 degrees and 45 degrees. Preferably, the angle $\alpha$ may be equal to 15 degrees.

Referring to FIG. 1D to FIG. 1F, in the embodiment, the bushing 140 has a through groove 142. The positioning protrusion 131 is disposed in the through groove 142, and a height of the positioning protrusion 131 is less than a depth of the through groove 142. Through the cooperation of the positioning protrusion 131 and the through groove 142, the bushing 140 can reciprocate or slide radially relative to the bushing seat 130 within a set stroke, and cannot rotate relative to the bushing seat 130. In terms of the main extending direction of the through groove 142, the through groove 142 is deflected at the angle $\alpha$ relative to the straight line 103 connected by the plurality of contact points 101. Furthermore, the positioning protrusion 131 has a positioning reference line 131*a* passing through the main axis 13*b* and parallel to the through groove 142, and the angle $\alpha$ is included between the positioning reference line 131*a* and the straight line 103 connected by the plurality of contact points 101.

In other words, the cooperation between the positioning protrusion 131 and the through groove 142 determines the sliding path and retreat path of the bushing 140 and the orbiting scroll 120, and the sliding path and retreat path of the bushing 140 coincide with the positioning reference line 131*a*. Therefore, the angle α is included between the sliding path and the retreat path of the bushing 140 and the straight line 103 connected by the plurality of contact points 101.

Referring to FIG. 1F, the positioning protrusion 131 also has two long sides 1311 that are opposite to each other and two short sides 1312 that are opposite to each other, and the two short sides 1312 are connected between the two long sides 1311. Specifically, since the two long sides 1311 are parallel to the positioning reference line 131*a*, the two long sides 1311 can be deflected at the angle α relative to the straight line 103 connected by the plurality of contact points 101 in the clockwise and counterclockwise directions respectively. In addition, the positioning reference line 131*a* extends through the two short sides 1312.

Correspondingly, the through groove 142 has two long sides 1421 respectively facing the two long sides 1311 and two short sides 1422 respectively facing the two short sides 1312. The two long sides 1421 are parallel to the positioning reference line 131*a*, and the positioning reference line 131*a* extends through the two short sides 1422. Since the two long sides 1421 are parallel to the positioning reference line 131*a*, the two long sides 1421 may be deflected at the angle α relative to the straight line 103 connected by the plurality of contact points 101 in the clockwise and counterclockwise directions respectively.

Referring to FIG. 1D to FIG. 1F, during the orbiting process of the orbiting scroll 120 relative to the stationary scroll 110, the orbiting scroll 120, the bearing 150, and the bushing 140 can slide synchronously relative to the bushing seat 130 and the stationary scroll 110 in the radial direction, and the radial sliding path and the retreat path of the bushing 140 are deflected at the angle α relative to the straight line 103 connected by the plurality of contact points 101 (that is, the radial sliding path and the retreat path of the bushing 140 do not coincide with the straight line 103 connected by the plurality of contact points 101). Since the direction of the straight line 103 is different from the retreat direction (parallel to the positioning reference line 131*a*), even if abnormally high pressure is generated in the plurality of compression spaces 102, the orbiting scroll 120, the bearing 150, and the bushing 140 can still slide in the radial direction or retreat radially to maintain the smoothness of the orbiting of the orbiting scroll 120 and help improve the operating efficiency of the compressor 10.

Referring to FIG. 1C and FIG. 1D, in the embodiment, the second compression mechanism 100 further includes a fixing block 160 and a locking member 170. The fixing block 160 is disposed in the bushing 140 and abuts against the positioning protrusion 131. On the other hand, the locking member 170 passes through the fixing block 160 and the positioning protrusion 131 to be locked into the end portion 13*a* of the driving shaft 13 so as to position the bushing seat 130 at the end portion 13*a* of the driving shaft 13. For example, the locking member 170 may be a bolt.

As shown in FIG. 1D and FIG. 1F, the positioning protrusion 131 also has a first through hole 131*b*, and the main axis 13*b* of the driving shaft 13 passes through the first through hole 131*b*. The locking member 170 first passes through the fixing block 160 and then through the first through hole 131*b* to be then locked into the end portion 13*a* of the driving shaft 13 so as to position the orbiting scroll 120, the bearing 150, the bushing 140, and the bushing seat 130 in the end portion 13*a* of the driving shaft 13.

On the other hand, the positioning protrusion 131 also has a second through hole 131*c*. A connection line between the first through hole 131*b* and the second through hole 131*c* coincides with the positioning reference line 131*a*, and is deflected at the angle α relative to the straight line 103 connected by the plurality of contact points 101. That is to say, the first through hole 131*b* is used to adjust the positioning protrusion 131 to produce the deflection angle α, and the connection line between the first through hole 131*b* and the second through hole 131*c* fixes the deflection angle α of the positioning protrusion 131, so that the retreat direction (parallel to the positioning reference line 131*a*) of the orbiting scroll 120, the bearing 150, and the bushing 140 avoids the plurality of contact points 101 or the straight line 103 between the orbiting scroll 120 and the stationary scroll 110. Therefore, a small acting force (which can be called a retreating force) can be used to cause the retreat to prevent severe abrasion in specific areas of the bearing 150 due to excessive force.

Figure 2A:
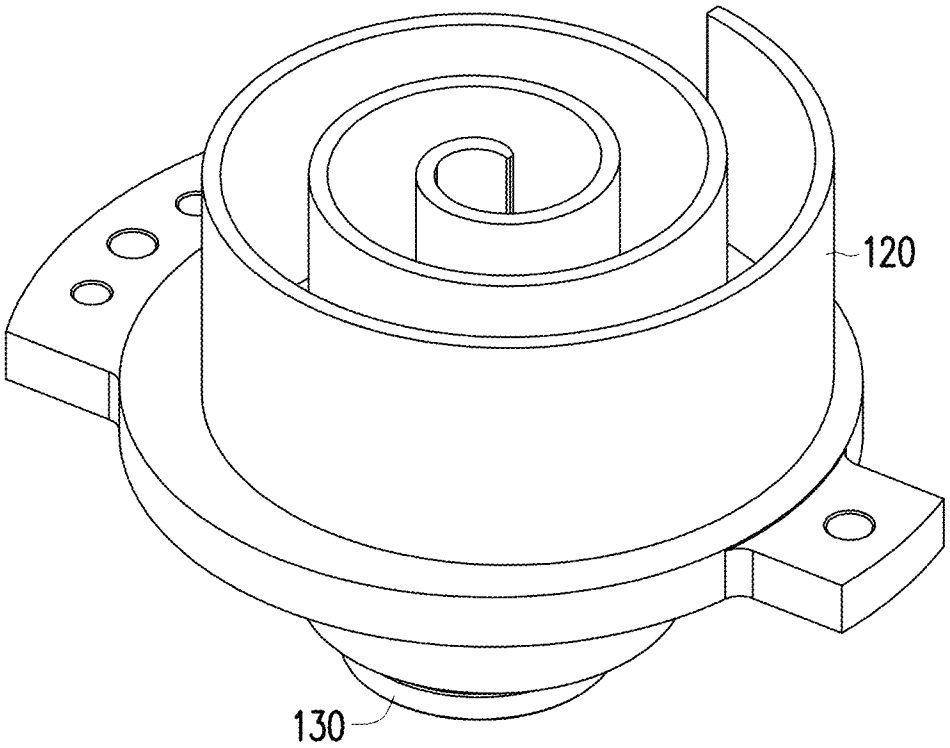
FIG. 2A is a schematic view of a combination of an orbiting scroll and a bushing seat according to an embodiment of the disclosure.
Figure 2B:
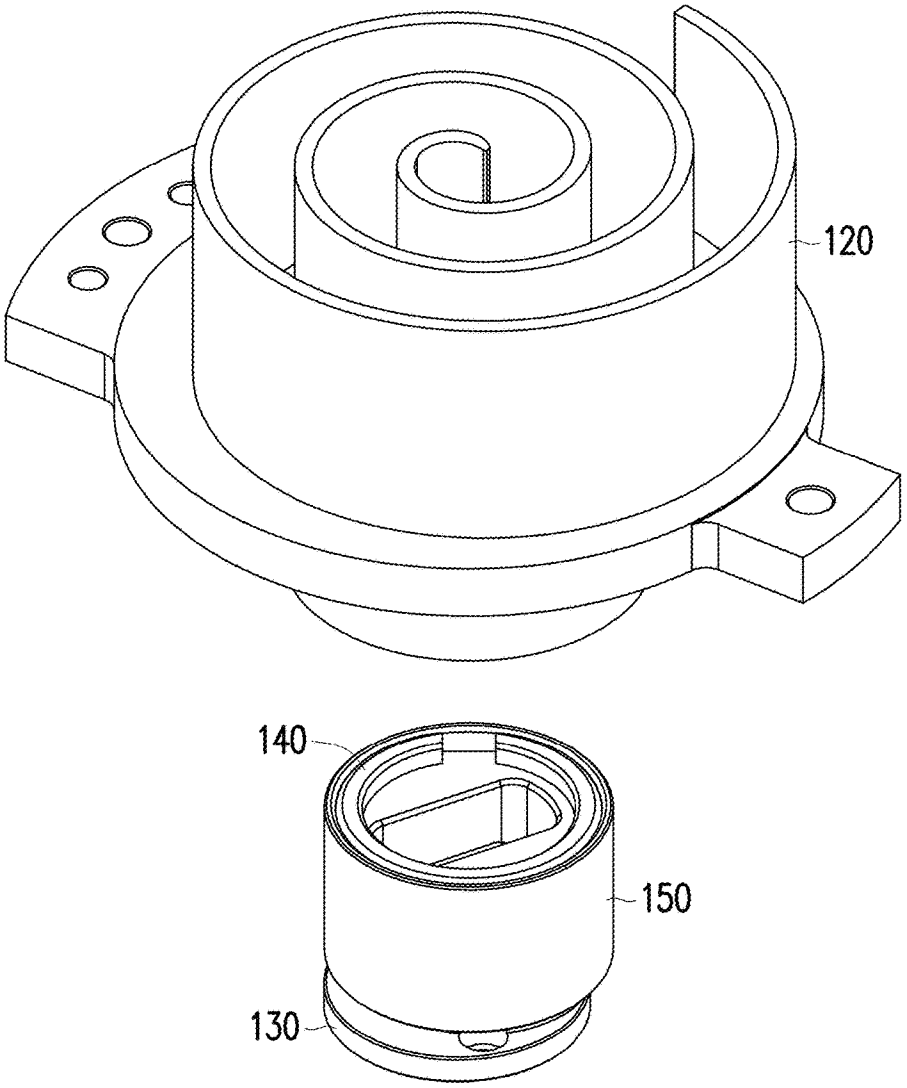
FIG. 2B is a schematic exploded view of FIG. 2A.
Figure 2C:
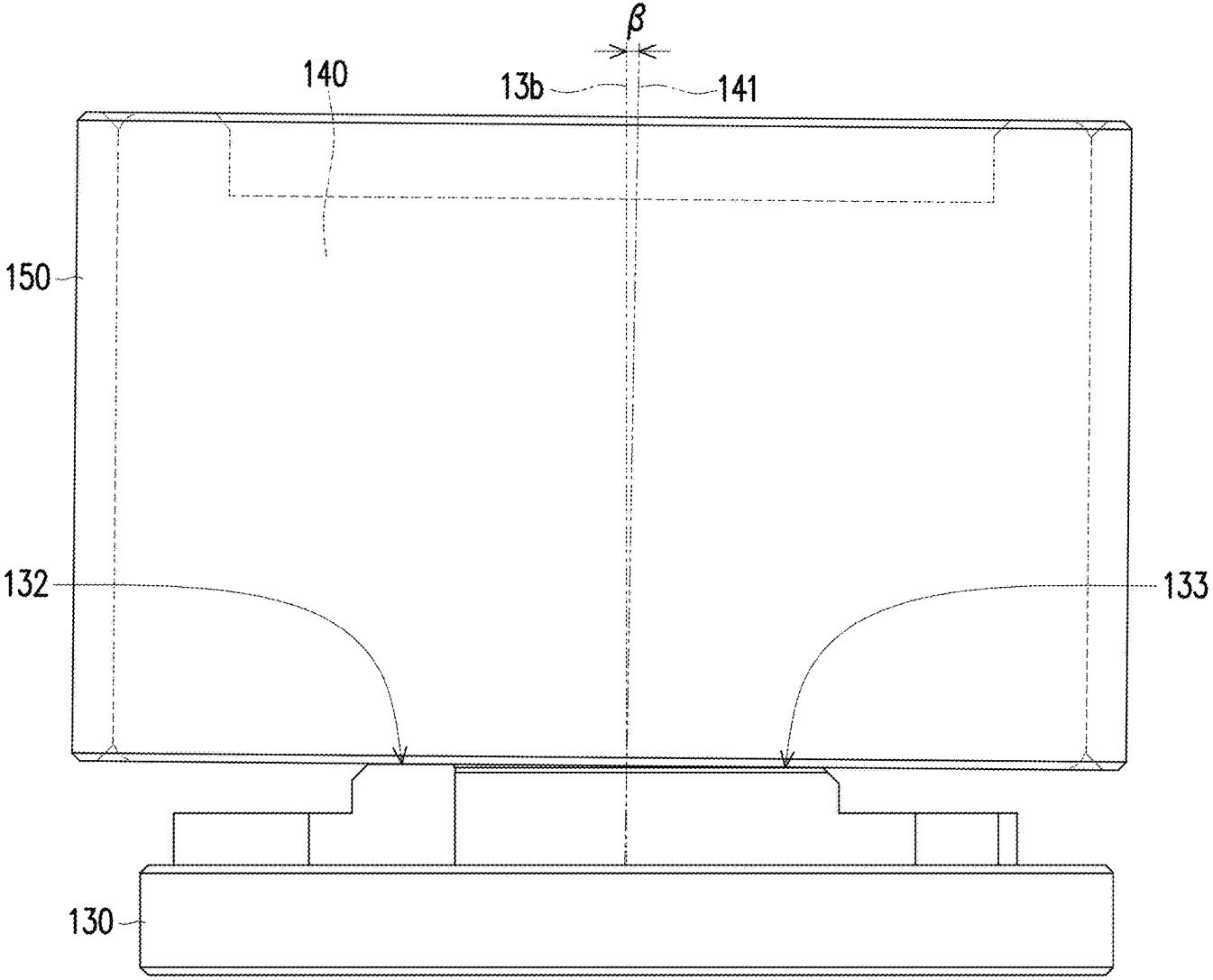
FIG. 2C is a schematic front view of the bearing, bushing, and bushing seat of FIG. 2B.

FIG. 2A is a schematic view of a combination of an orbiting scroll and a bushing seat according to an embodiment of the disclosure. FIG. 2B is a schematic exploded view of FIG. 2A. FIG. 2C is a schematic front view of the bearing, bushing, and bushing seat of FIG. 2B. Referring to FIG. 2A to FIG. 2C, In the embodiment, the bushing 140 is supported on the bushing seat 130, and the center line 141 of the bushing 140 is inclined at an angle β relative to the main axis 13*b*, and the angle β may be between 0.5 and 5 degrees.

As shown in FIG. 1F, FIG. 2A, and FIG. 2C, the bearing 150 is inclined along with the bushing 140 relative to the main axis 13*b*. However, the orbiting scroll 120 is not inclined relative to the main axis 13*b*. Therefore, the bearing 150 can receive the force evenly when the orbiting scroll 120 orbits, thereby preventing severe abrasion in specific areas of the bearing 150 due to excessive force to improve the operating efficiency and the lifetime of the compressor 10. In addition, when the orbiting scroll 120 orbits relative to the stationary scroll 110, the retreat direction of the orbiting scroll 120 is parallel to the long side 1311 of the positioning protrusion 131 or the positioning reference line 131*a*, and avoids the plurality of contact points 101 or the straight line 103 between the orbiting scroll 120 and the stationary scroll 110. Therefore, the centripetal force of the orbiting scroll 120 during orbiting is small, so that a small acting force (which can be called a retreating force) is used to cause the retreat in the radial direction, thereby preventing severe abrasion in specific areas of the bearing 150 due to excessive force.

Figure 2E:
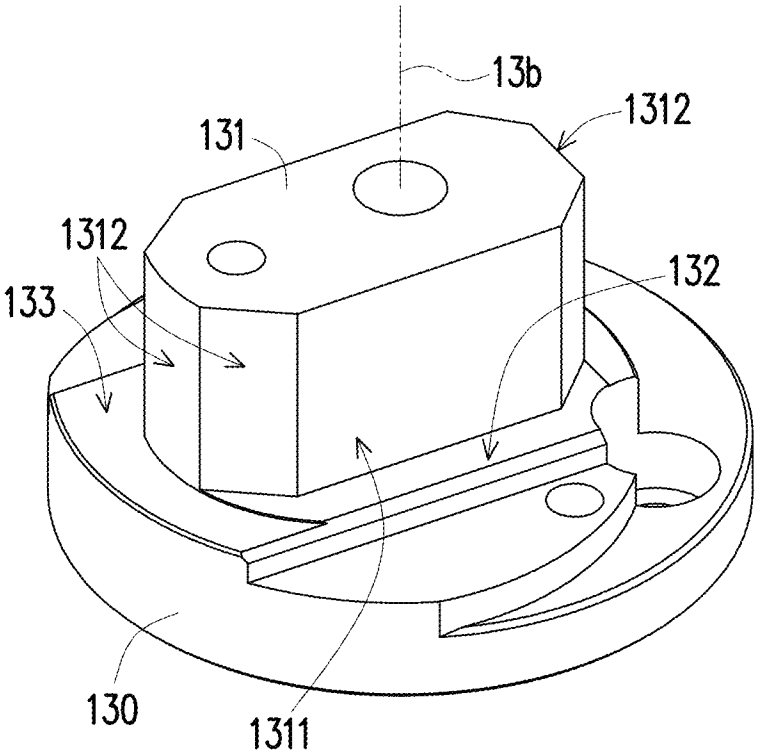
FIG. 2D and FIG. 2E are schematic views of the bushing seat of FIG. 2C from two different viewing angles.
Figure 2D:
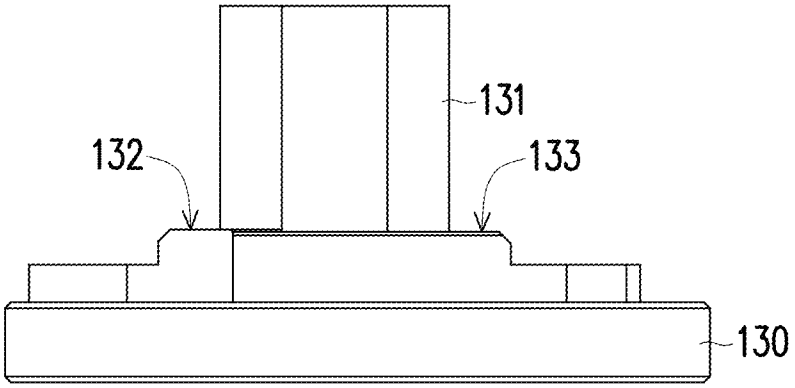

FIG. 2D and FIG. 2E are schematic views of the bushing seat of FIG. 2C from two different viewing angles. Referring to FIG. 2C to FIG. 2E, the bushing seat 130 also has a first supporting surface 132 and a second supporting surface 133 connected to the first supporting surface 132, and the positioning protrusion 131 protrudes from the first supporting surface 132 and the second supporting surface 133. In detail, the first supporting surface 132 is higher than the second supporting surface 133. The bushing 140 that is in contact with the first supporting surface 132 and the second supporting surface 133 may be inclined due to a height difference between the first supporting surface 132 and the second supporting surface 133 such that the center line 141 of the bushing 140 is inclined relative to the main axis 13*b*. On the other hand, in order to ensure that the bushing 140 that is in contact with the first supporting surface 132 and the second supporting surface 133 is inclined on the bushing seat 130, an area of the first supporting surface 132 with the higher height is less than an area of the second supporting surface 133 with the lower height.

As shown in FIG. 2D and FIG. 2E, the height difference between the first supporting surface 132 and the second supporting surface 133 is between 0.5 mm and 5 mm. In addition, a distribution range of the second supporting surface 133 extends along one of the long sides 1311 to the two short sides 1312, and extends to at least half of each short side 1312. That is, the distribution is between ½ of a side length of the short side 1312 and an entire side length.

Figure 3B:
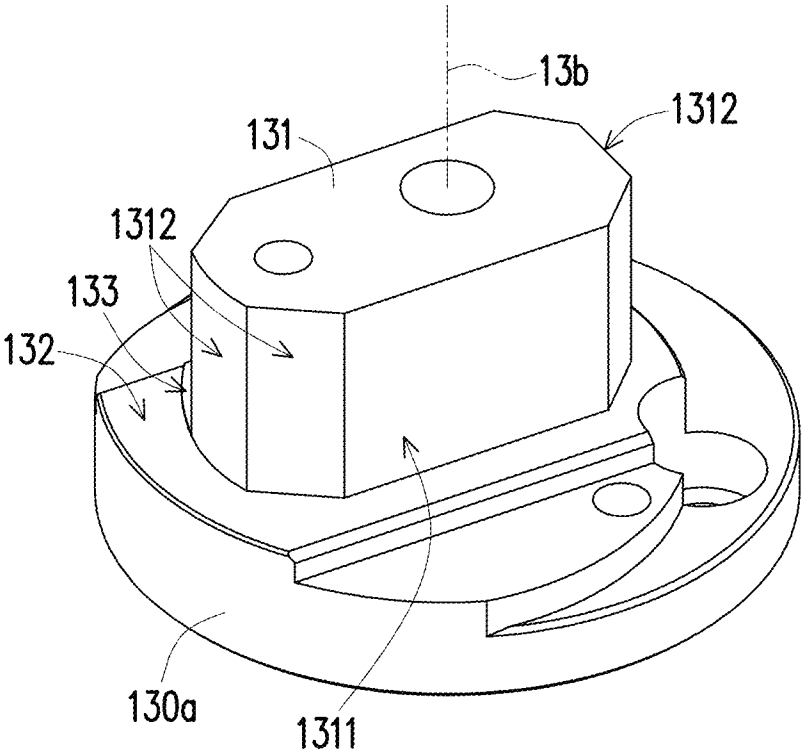
FIG. 3A and FIG. 3B are schematic views of a bushing seat from two different viewing angles according to another embodiment of the disclosure.
Figure 3A:
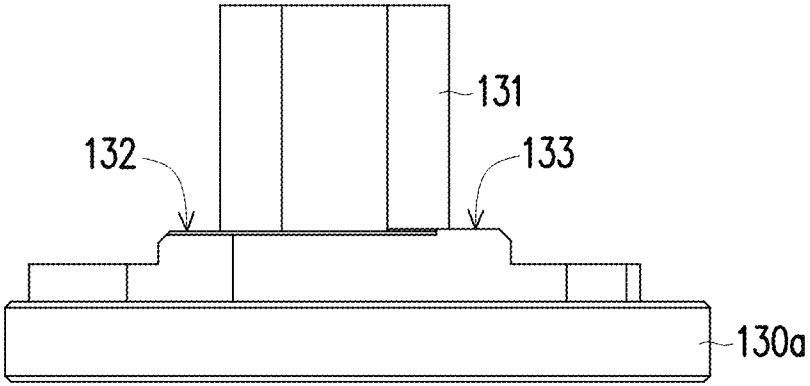

FIG. 3A and FIG. 3B are schematic views of a bushing seat from two different viewing angles according to another embodiment of the disclosure. Referring to FIG. 3A and FIG. 3B, different from the bushing seat 130 shown in FIG. 2D and FIG. 2E, the second supporting surface 133 of a bushing seat 130*a* in the embodiment is higher than the first supporting surface 132, and the area of the second supporting surface 133 with the higher height is less than the area of the first supporting surface 132 with the lower height. Specifically, a distribution range of the first supporting surface 132 extends along one of the long sides 1311 to the two short sides 1312, and extends to at least half of each short side 1312. That is, the distribution is between ½ of the side length of the short side 1312 and the entire side length, as shown in FIG. 3B.

A height design of the two supporting surfaces of the bushing seat is determined by the orbiting direction of the orbiting scroll. For example, the bushing seat 130 shown in FIG. 2D and FIG. 2E is suitable for the orbiting scroll that orbits clockwise such that the orbiting scroll that starts to orbit first passes through the lower surface (i.e., the second supporting surface 133). In contrast, the bushing seat 130*a* shown in FIG. 3A and FIG. 3B is suitable for the orbiting scroll that orbits counterclockwise such that the orbiting scroll that starts to orbit first passes through the lower surface (i.e., the first supporting surface 132). When the orbiting scroll 120 retreats, the second supporting surface 133 on which the bottom of the bushing seat 130 rests is a low surface instead of a high surface, so that the retreat resistance is smaller. The orbiting scroll 120 can retreat through a small acting force (which can be called a retreating force), thereby preventing severe abrasion in specific areas of the bearing 150 due to excessive force.

Figure 4A:
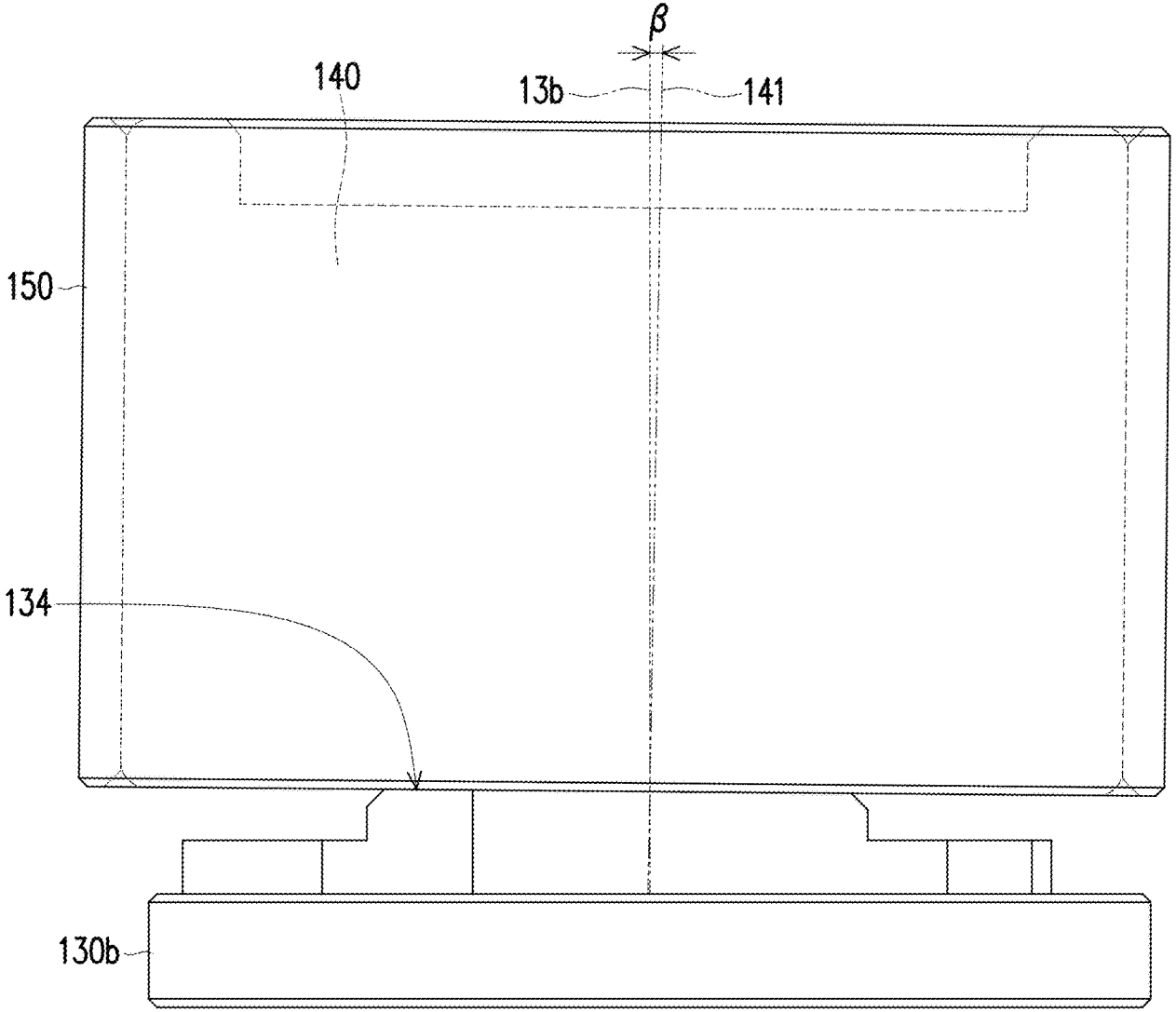
FIG. 4A is a schematic front view of a bearing, a bushing, and a bushing seat according to another embodiment of the disclosure.
Figure 4B:
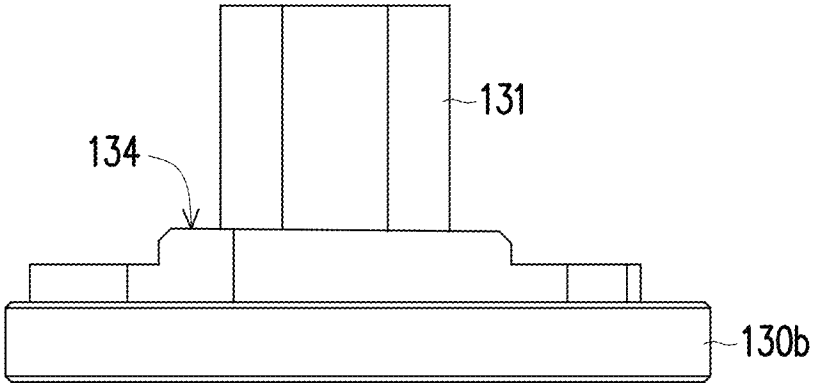
FIG. 4B is a schematic view of the bushing seat of FIG. 4A.

FIG. 4A is a schematic front view of a bearing, a bushing, and a bushing seat according to another embodiment of the disclosure. FIG. 4B is a schematic view of the bushing seat of FIG. 4A. Referring to FIG. 4A and FIG. 4B, different from the bushing seat 130 or the bushing seat 130*a* in the previous embodiments, a supporting surface of a bushing seat 130*b* in the embodiment is a supporting slope 134. In detail, the bushing 140 is in contact with the supporting slope 134 such that the center line 141 of the bushing 140 is inclined at the angle β relative to the main axis 13*b*, and the angle β may be between 0.5 degrees and 5 degrees.

A height design of the supporting slope of the bushing seat is determined by the orbiting direction of the orbiting scroll. For example, the bushing seat with the supporting slope that is high on the left and low on the right is suitable for the orbiting scroll that orbits clockwise such that the orbiting scroll that starts to orbit first passes through the lower surface. Correspondingly, the bushing seat with the supporting slope that is high on the right and low on the left is suitable for the orbiting scroll that orbits counterclockwise such that the orbiting scroll that starts to orbit first passes through the lower surface.

Figure 5:
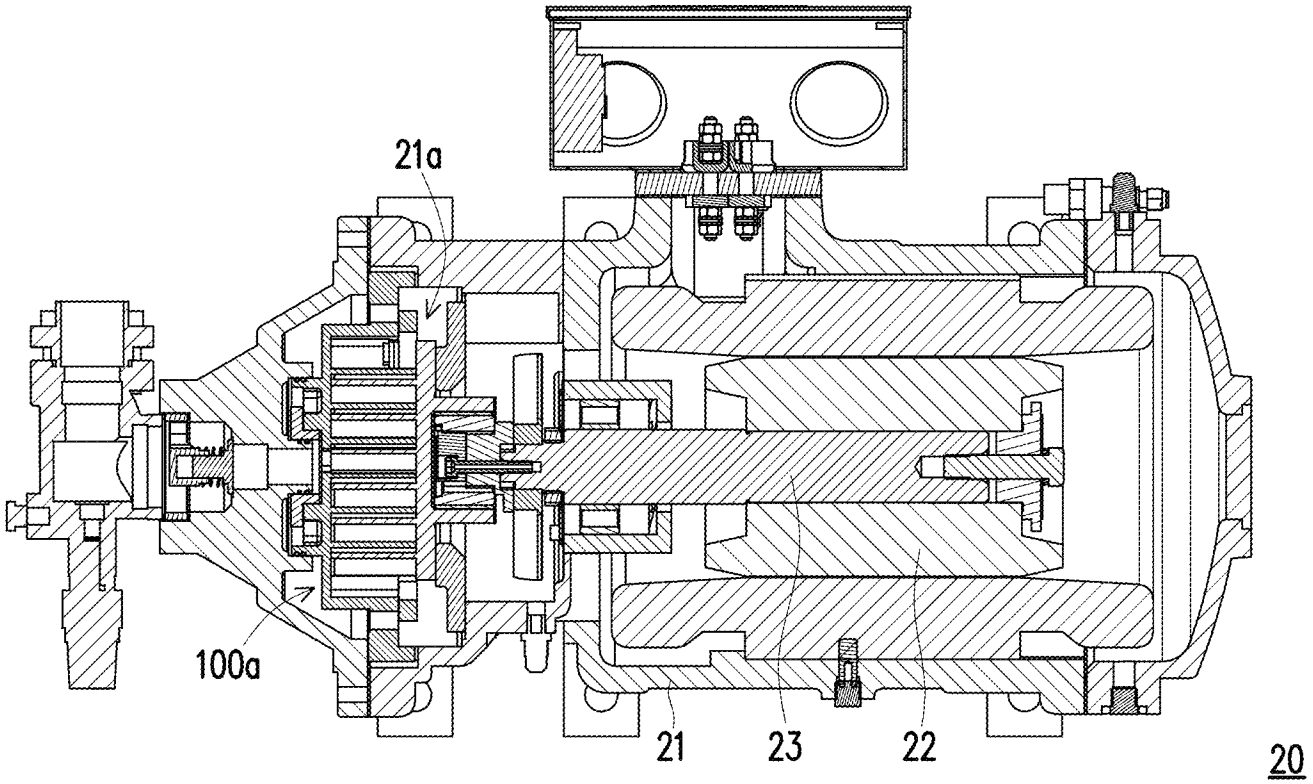
FIG. 5 is a schematic cross-sectional view of a compressor according to another embodiment of the disclosure.

FIG. 5 is a schematic cross-sectional view of a compressor according to another embodiment of the disclosure. The compressor 10 of the previous embodiment is a two-stage compressor, and its two compression chambers that are communicated with each other are respectively disposed with the screw compression mechanism and the scroll compression mechanism. In comparison, a compressor 20 shown in FIG. 5 is a single-stage compressor, and its housing 21 has a single compression chamber 21*a*, and a single compression mechanism 100*a*, such as a scroll compression mechanism, is configured in the compression chamber 21*a*.

As shown in FIG. 5, a motor 22 and a driving shaft 23 are disposed in the housing 21. The driving shaft 23 is connected to the motor 22 and extends into the compression chamber 21*a* to be connected to the compression mechanism 100*a*. Specifically, the motor 22 can drive the compression mechanism 100*a* to operate through the driving shaft 23, so that the low-pressure gaseous fluid in the compression chamber 21*a* is compressed by the compression mechanism 100*a* to form a high-pressure gaseous fluid, which is then discharged from the compression chamber 21*a*.

The compression mechanism 100*a* of the embodiment is a scroll compression mechanism and has the same structural design as the second compression mechanism 100 of the previous embodiment. For example, the cooperation between the stationary scroll and the orbiting scroll, the structural design of the bushing seat, the cooperation between the bushing seat and the driving shaft, the structural design of the bushing, the cooperation between the bushing and the bushing seat, the relative relationship between the center line of the bushing and the main axis of the driving shaft (such as eccentricity and inclination), and the cooperation of the bushing, the bearing, and the orbiting scroll are all the same, and therefore will not be repeated here.

In summary, in the compressor of the disclosure, the bushing seat is positioned at the end portion of the driving shaft. The orbiting scroll is connected to the positioning protrusion of the bushing seat through the bearing and the bushing, and the center line of the bushing is eccentric to the main axis of the driving shaft due to the height difference between the first supporting surface and the second supporting surface (or supporting slope). Specifically, the plurality of contact points between the orbiting scroll and the stationary scroll form a plurality of closed spaces, and the positioning protrusion is deflected at an angle relative to the straight line connected by the plurality of contact points such that the retreat direction is different from the direction of the straight line. In addition, the supporting surface (or supporting slope) is a low surface when the orbiting scroll retracts, and the retreat resistance of the orbiting scroll is small. Therefore, a small acting force can be used to cause the retreat, so that the bearing can receive the force evenly when the orbiting scroll orbits, thereby preventing severe abrasion in specific areas of the bearing due to excessive force to improve the operating efficiency and the lifetime of the compressor.

On the other hand, during the orbiting process of the orbiting scroll relative to the stationary scroll, the orbiting scroll, the bearing, and the bushing can slide relative to the stationary scroll synchronously in the radial direction. Since the radial sliding path or retreat path of the bushing is deflected at an angle relative to the straight line connected by the plurality of contact points (that is, the radial sliding path or retreat path of the bushing does not coincide with the straight line connected by the plurality of contact points), even if abnormally high pressure is generated in the plurality of compression spaces, the orbiting scroll, the bearing, and the bushing can still slide in the radial direction or retreat radially to maintain the smoothness of the orbiting of the orbiting scroll and help improve the operating efficiency of the compressor.

Although the disclosure has been described with reference to the embodiments above, the embodiments are not intended to limit the disclosure. Any person skilled in the art can make some changes and modifications without departing from the spirit and scope of the disclosure. Therefore, the scope of the disclosure will be defined in the appended claims.

What is claimed is:

1. A compressor, comprising:

a housing, having a first compression chamber and a second compression chamber that are communicated with each other;

a motor, disposed in the housing;

a driving shaft, connected to the motor, wherein the driving shaft passes through the first compression chamber and extends into the second compression chamber;

a first compression mechanism, disposed in the first compression chamber, and connected to the driving shaft; and a second compression mechanism, disposed in the second compression chamber, and comprising:

a stationary scroll;

an orbiting scroll, engaged with the stationary scroll, wherein there are a plurality of contact points between the orbiting scroll and the stationary scroll to form a plurality of compression spaces;

a bushing seat, positioned at an end portion of the driving shaft, and having a positioning protrusion, wherein a main axis of the driving shaft passes through the positioning protrusion, and the positioning protrusion is deflected at an angle relative to a straight line connected by the contact points;

a bushing, sleeved on the positioning protrusion, wherein a center line of the bushing is eccentric to the main axis and is inclined relative to the main axis; and a bearing, sleeved on the bushing, wherein the orbiting scroll is sleeved on the bearing, wherein the bushing seat has one of:

A) a first supporting surface and a second supporting surface connected to the first supporting surface, the positioning protrusion protrudes from the first supporting surface and the second supporting surface, there is a height difference between the first supporting surface and the second supporting surface, the bushing is in contact with the first supporting surface and the second supporting surface, or B) a supporting slope, the positioning protrusion protrudes from the supporting slope, the bushing is in contact with the supporting slope.

2. The compressor according to claim 1, wherein the bushing has a through groove, the positioning protrusion is disposed in the through groove, and the through groove is deflected at the angle relative to the straight line connected by the contact points.

3. The compressor according to claim 2, wherein the positioning protrusion has a positioning reference line passing through the main axis and parallel to the through groove, and the angle is included between the positioning reference line and the straight line connected by the contact points.

4. The compressor according to claim 1, wherein the bushing is adapted to slide reciprocally along a sliding path relative to the bushing seat, and the angle is included between the sliding path and the straight line connected by the contact points.

5. The compressor according to claim 4, wherein the positioning protrusion has a positioning reference line passing through the main axis, the positioning reference line coincides with the sliding path, and the angle is included between the positioning reference line and the straight line connected by the contact points.

6. The compressor according to claim 1, wherein the angle is an acute angle.

7. The compressor according to claim 6, wherein the angle is between 5 degrees and 45 degrees.

8. The compressor according to claim 7, wherein the angle is equal to 15 degrees.

9. The compressor according to claim 1, wherein the positioning protrusion has a long side and a short side connected to the long side, and the long side is deflected at the angle relative to the straight line connected by the contact points.

10. The compressor according to claim 1, wherein the second compression mechanism further comprises:

a fixing block, disposed in the bushing, and abutting against the positioning protrusion; and a locking member, passing through the fixing block and the positioning protrusion to be locked into the end portion of the driving shaft.

11. The compressor according to claim 10, wherein the positioning protrusion has a first through hole, the main axis of the driving shaft passes through the first through hole, and the locking member passes through the first through hole to be locked into the end portion of the driving shaft.

12. The compressor according to claim 11, wherein the positioning protrusion further has a second through hole, and a connection line between the first through hole and the second through hole is deflected at the angle relative to the straight line connected by the contact points.

13. The compressor according to claim 1, wherein the center line of the bushing is inclined from 0.5 to 5 degrees relative to the main axis.

14. The compressor according to claim 1, wherein one of the first supporting surface and the second supporting surface is higher than the other of the first supporting surface and the second supporting surface, and an area of a higher one of the first supporting surface and the second supporting surface is less than an area of a lower one of the first supporting surface and the second supporting surface.

15. The compressor according to claim 1, wherein the height difference between the first supporting surface and the second supporting surface is between 0.05 mm and 0.5 mm.

16. The compressor according to claim 1, wherein the positioning protrusion has two long sides that are opposite to each other and two short sides that are opposite to each other, the two short sides are connected between the two long sides, and a distribution range of the first supporting surface extends along one of the long sides to the two short sides, and extends to at least half of each short side.

17. The compressor according to claim 1, wherein the first compression mechanism is a screw compression mechanism.

18. A compressor, comprising:

a housing, having a compression chamber;

a motor, disposed in the housing;

a driving shaft, connected to the motor, wherein the driving shaft extends into the compression chamber; and a compression mechanism, disposed in the compression chamber, and comprising:

a stationary scroll;

an orbiting scroll, engaged with the stationary scroll, wherein there are a plurality of contact points between the orbiting scroll and the stationary scroll to form a plurality of compression spaces;

a bushing seat, positioned at an end portion of the driving shaft, and having a positioning protrusion, wherein a main axis of the driving shaft passes through the positioning protrusion, and the positioning protrusion is deflected at an angle relative to a straight line connected by the contact points;

a bushing, sleeved on the positioning protrusion, wherein a center line of the bushing is eccentric to the main axis and is inclined relative to the main axis; and a bearing, sleeved on the bushing, wherein the orbiting scroll is sleeved on the bearing, wherein the bushing seat has one of:

A) a first supporting surface and a second supporting surface connected to the first supporting surface, the positioning protrusion protrudes from the first supporting surface and the second supporting surface, there is a height difference between the first supporting surface and the second supporting surface, the bushing is in contact with the first supporting surface and the second supporting surface, or B) a supporting slope, the positioning protrusion protrudes from the supporting slope, the bushing is in contact with the supporting slope.

19. The compressor according to claim 18, wherein the bushing has a through groove, the positioning protrusion is disposed in the through groove, the through groove is deflected at the angle relative to the straight line connected by the contact points, the positioning protrusion has a positioning reference line passing through the main axis and parallel to the through groove, and the angle is included between the positioning reference line and the straight line connected by the contact points.

20. The compressor according to claim 18, wherein the bushing is adapted to slide reciprocally along a sliding path relative to the bushing seat, the angle is included between the sliding path and the straight line connected by the contact points, the positioning protrusion has a positioning reference line passing through the main axis, the positioning reference line coincides with the sliding path, and the angle is included between the positioning reference line and the straight line connected by the contact points.

21. The compressor according to claim 18, wherein the angle is between 5 degrees and 45 degrees.

22. The compressor according to claim 18, wherein the center line of the bushing is inclined from 0.5 to 5 degrees relative to the main axis.

23. The compressor according to claim 18, wherein one of the first supporting surface and the second supporting surface is higher than the other of the first supporting surface and the second supporting surface, and an area of a higher one of the first supporting surface and the second supporting surface is less than an area of a lower one of the first supporting surface and the second supporting surface.

24. The compressor according to claim 18, wherein the height difference between the first supporting surface and the second supporting surface is between 0.05 mm and 0.5 mm.

* * * * *